US005203196A

United States Patent [19]

Jenkins

[11] Patent Number: 5,203,196

[45] Date of Patent: Apr. 20, 1993

[54] DENT PULLER

[76] Inventor: Fremont T. Jenkins, 70235 Beach Dr., Edwardsburg, Mich. 49112

[21] Appl. No.: 772,573

[22] Filed: Oct. 7, 1991

[51] Int. Cl.[5] ..... B21D 1/12

[52] U.S. Cl. ..... 72/391.2; 72/705

[58] Field of Search ..... 72/391.2, 391.4, 457, 72/458, 705

[56] References Cited

U.S. PATENT DOCUMENTS

| | | | |
|---|---|---|---|
| 2,256,130 | 9/1941 | Trachsel | 72/705 |
| 3,003,657 | 10/1961 | Siebol et al. | 72/391.4 |
| 3,977,230 | 8/1976 | Jones | 72/705 |
| 4,089,201 | 5/1978 | Raptis | 72/705 |
| 4,827,759 | 5/1989 | Mattson | 72/705 |
| 4,885,925 | 12/1989 | Place et al. | 72/705 |

*Primary Examiner*—Lowell A. Larson

[57] ABSTRACT

An apparatus for removing small dents utilizes two specially designed tools. The first tool comprises a metal rod which resembles a blunt tipped nail, and the head of the nail is coated with a heat activated adhesive to facilitate its attachment to the deepest area of a dent. The second tool comprises a cone shaped device having open sides with the blunt tipped nail tool being positionable through the cone's longitudinal axis. The larger end of the cone utilizes interchangeable disks having various diameter holes, and the entire assembly is attachable to a conventional pulling tool when used to pull out a dent.

2 Claims, 5 Drawing Sheets

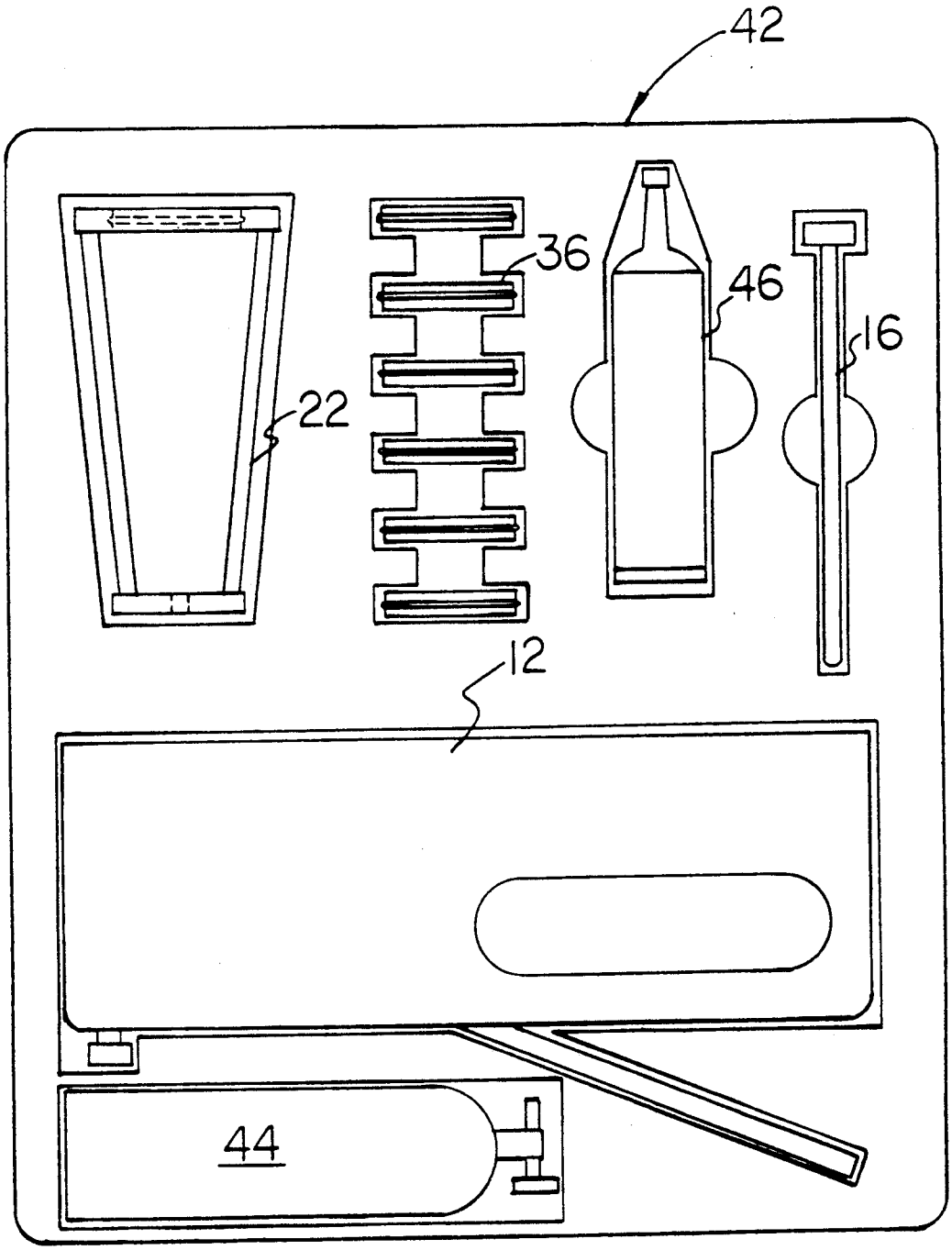
FIG 7
FIG 8
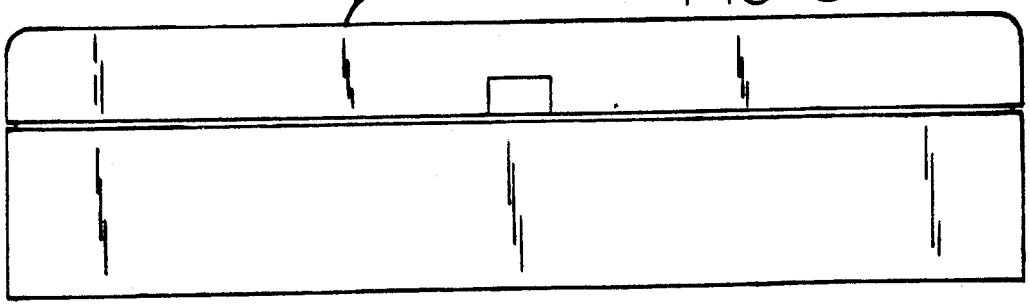

DENT PULLER

BACK ROUND OF THE INVENTION

1. Field of the Invention

The present invention relates to dent pullers and more particularly pertains to a dent puller which may be utilized to pull out small dents without damage to a vehicle's paint or body.

2. Description of the Prior Art

The use of portable dent pullers is known in the prior art. A typical example of a commercially available dent puller is to be found in U.S. Pat. No. 4,653,167 which issued to E. Mullins on Mar. 31, 1987. The dent reparing tool illustrated in the Mullins patent utilizes a drill bit to effect an attachment of the puller to the dent. This construction is typical of virtually all known types of dent pullers presently commercially available and as can be appreciated, these types of pullers result in some additional vehicle damage due to the fact that a small hole must normally be drilled through the vehicle's body. As such, there exists a continuing need for new and improved dent pullers which could lessen the amount of new and additional damage inflicted upon a vehicle's body when pre-existing dents are removed. In this respect, the present invention substantially fulfills this need.

SUMMARY OF THE INVENTION

In view of the foregoing disadvantages inherent in the known types of dent pullers now present in the prior art, the present invention provides an improved dent puller construction wherein the same can be utilized to remove small dents from a vehicle's body without inflicting any additional damage to the vehicle structure per se. As such, the general purpose of the present invention, which will be described subsequently in greater detail, is to provide a new and improved dent puller which has all the advantages of the prior art dent pullers and none of the disadvantages.

To attain this, the present invention essentially comprises an apparatus for removing small dents which utilizes two specially designed tools. The first tool comprises a metal rod which resembles a blunt tipped nail, and the head of the nail is coated with a heat activated adhesive to facilitate its attachment to the deepest area of a dent. The second tool comprises a cone shaped device having open sides with the blunt tipped nail tool being positionable through the cone's longitudinal axis. The larger end of the cone utilizes interchangeable disk having various diameter holes, and the entire assembly is attachable to a conventional pulling tool when used to pull out a dent.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invent ion to provide a new and improved dent puller which has all the advantages of the prior art dent pullers and none of the disadvantages.

It is another object of the present invention to provide a new and improved dent puller which may be easily and efficiently manufactured and marketed.

It is a further object of the present invention to provide a new and improved dent puller which is of a durable and reliable construction.

An even further object of the present invention is to provide a new and improved dent puller which is susceptible of a low cost of manufacture with regard to both materials and labor, and which accordingly is then susceptible of low prices of sale to the consuming public, thereby making such dent pullers economically available to the buying public.

Still yet another object of the present invention is to provide a new and improved dent puller which provides in the apparatuses and methods of the prior art some of the advantages thereof, while simultaneously overcoming some of the disadvantages normally associated therewith.

Still another object of the present invention is to provide a new and improved dent puller which eliminates the need for drilling a hole in a vehicle's body to effect an attachment thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF DRAWINGS

The invention will be better understood and objects other than those set forth above will become apparent when consideration is given to the following detailed description thereof. Such description makes reference to the annexed drawings wherein:

FIG. 7 is a top plan view of a complete kit illustrating all of the components of the present invention.

FIG. 8 is an end elevation view of the kit having a lid in a closed position.

DESCRIPTION OF THE PREFERRED EMBODIMENT

Figure 1:
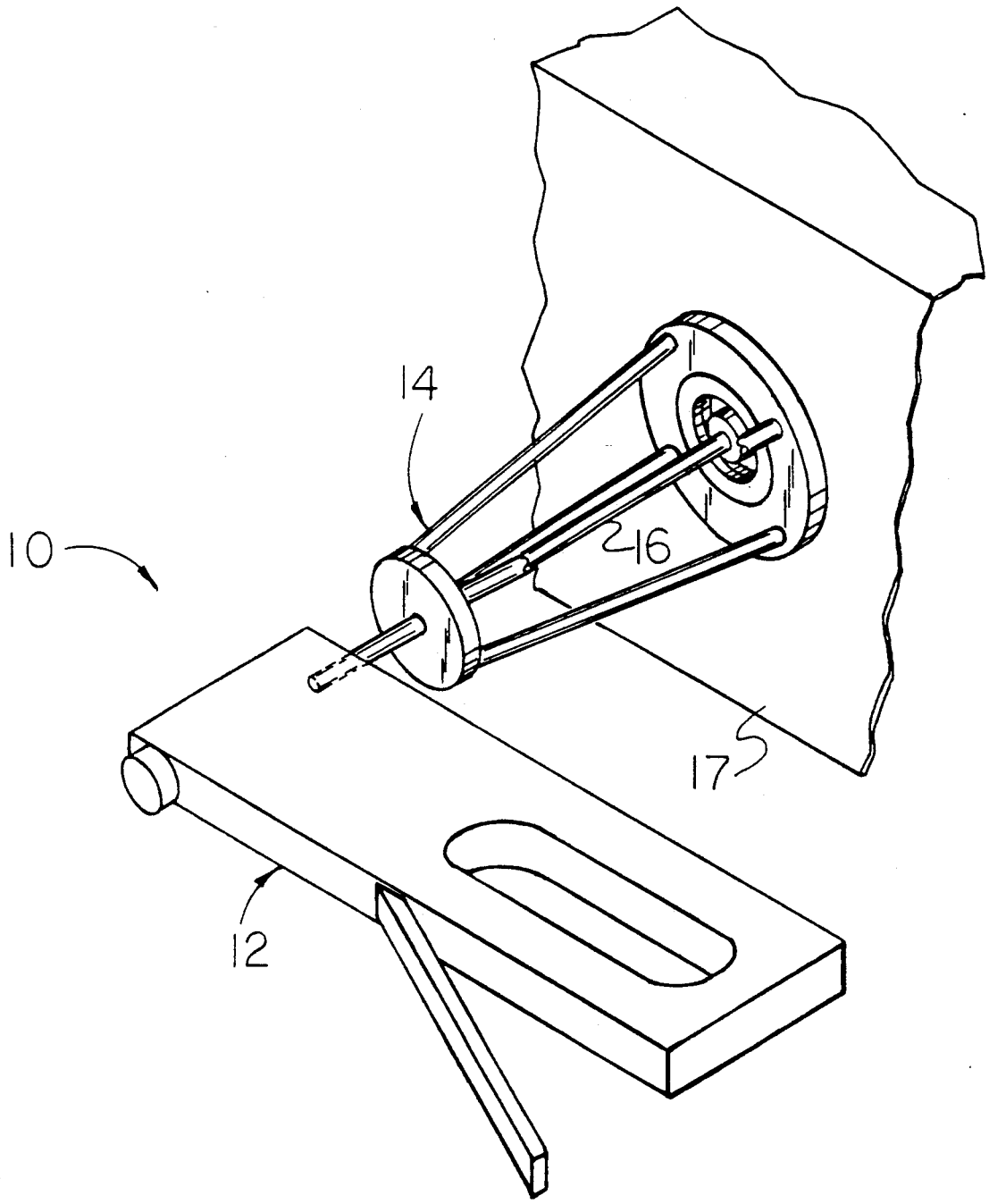
FIG. 1 is a perspective view of the dent puller comprising the present invention.
Figure 2:
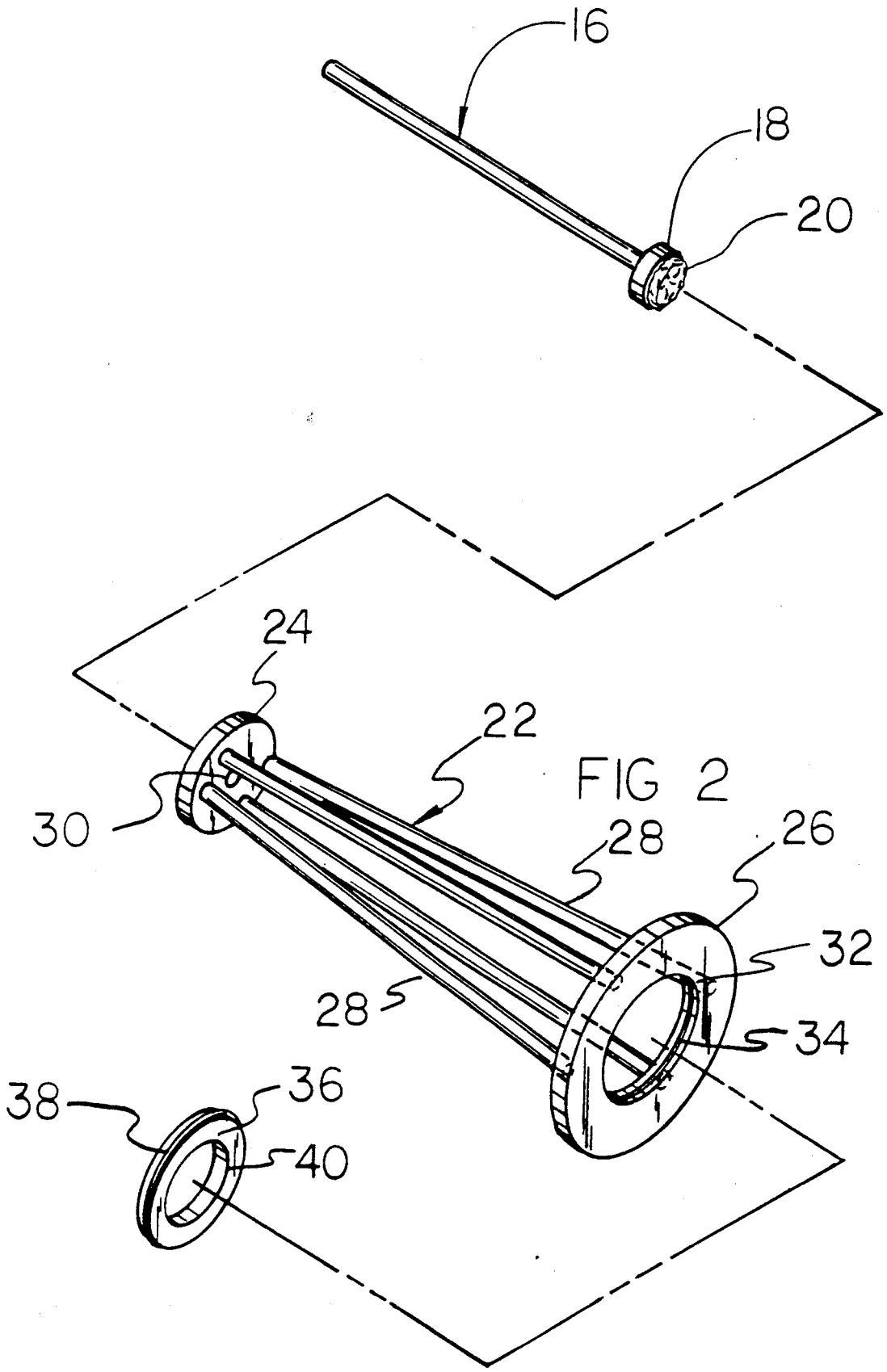
FIG. 2 is an exploded view of the cone assembly forming a part of the present invention.
Figure 3:
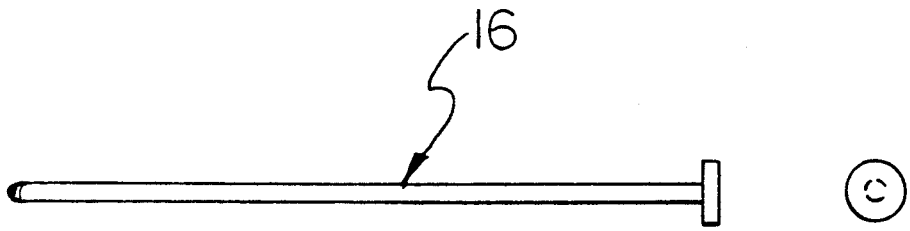
FIG. 3 is a side elevation view of the attachment rod forming a part of the present invention.
Figure 4:
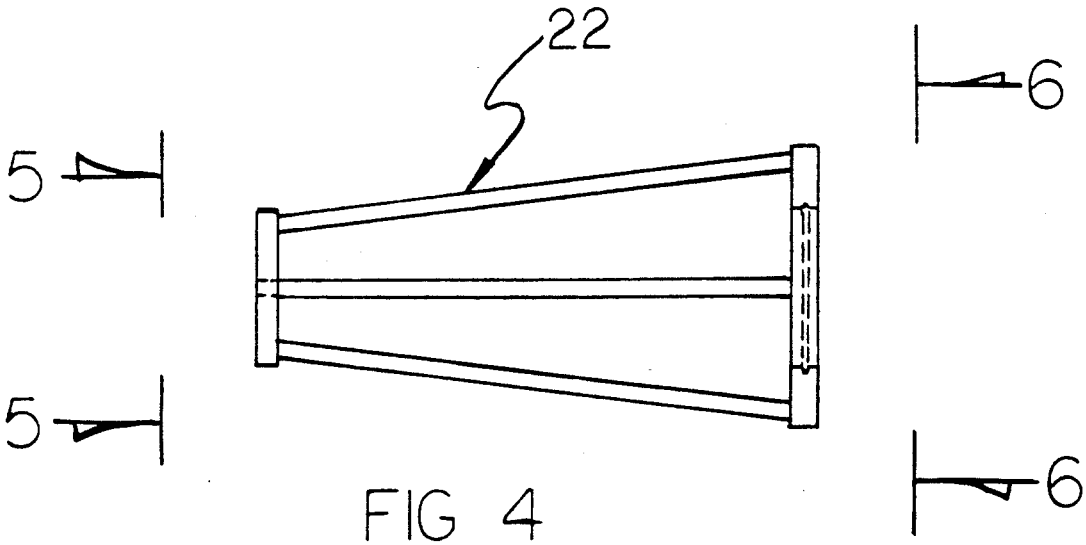
FIG. 4 is a side elevation view of the cone forming a part of the present invention.
Figure 5:
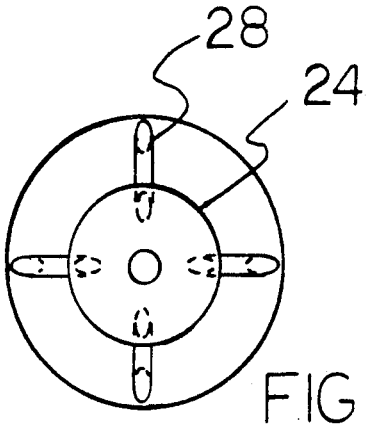
FIG. 5 is a left side elevation view of the cone as viewed along the line 5—5 in FIG. 4.
Figure 6:
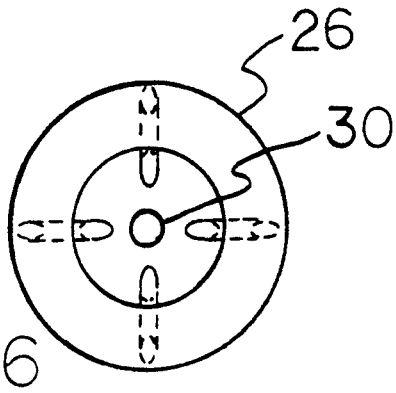
FIG. 6 is a right side elevation view of the cone as viewed along the line 6—6 in FIG. 4.
Figure 9:
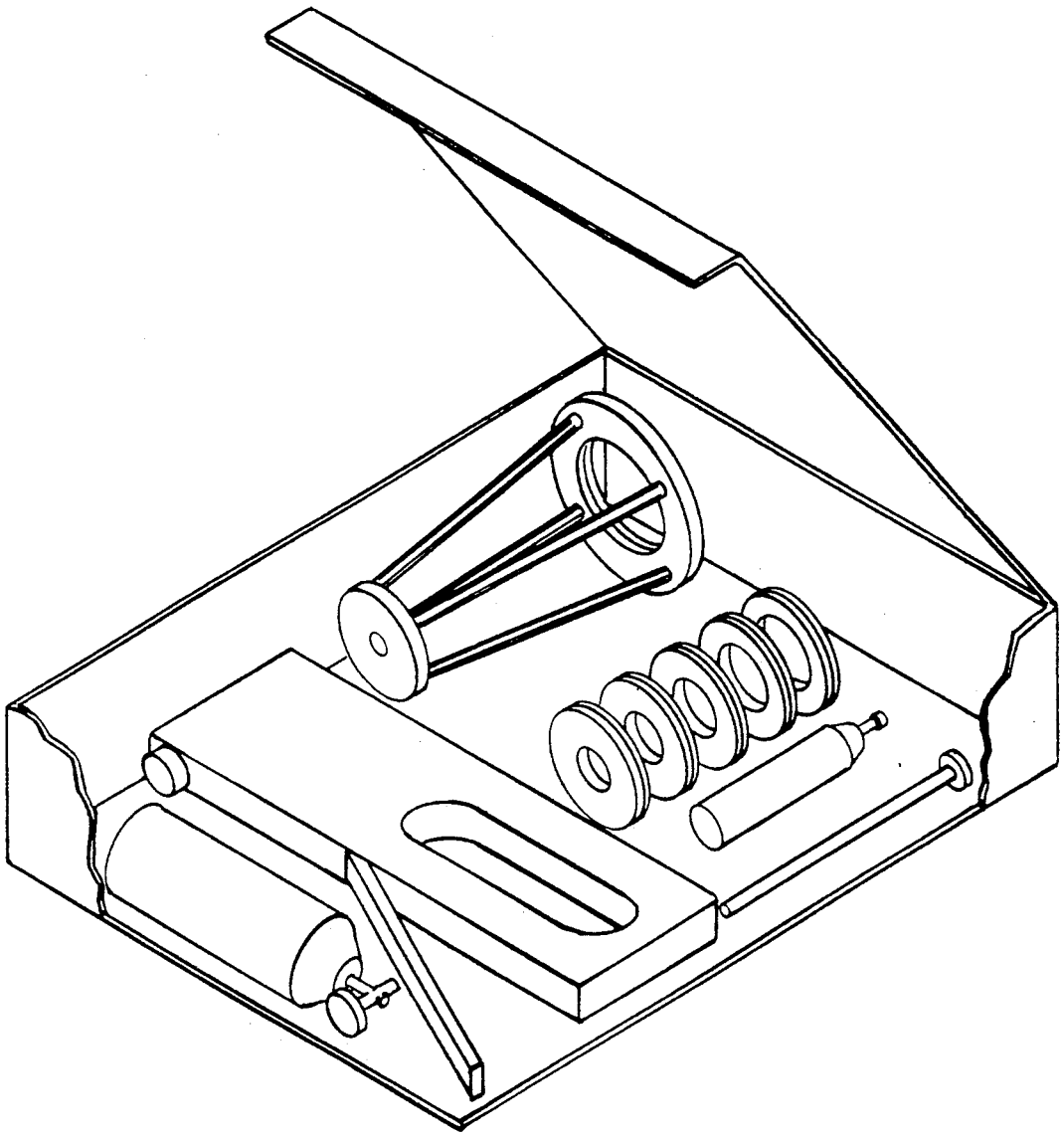
FIG. 9 is a perspective view of the tool kit.

With reference now to the drawings, and in particular to FIG. 1 thereof, a new and improved dent puller embodying the principles and concepts of the present invention and generally designated by the reference numeral 10 will be described.

More specifically, it will be noted that the dent puller 10 includes a conventional pulling tool 12 such as sold commercially under the Registered Trademark POP RIVET to which is attached a dent pulling cone assembly 14. A dent pulling rod 16 forms a part of the cone assembly 14 and is adhesively attachable to a dent present in the side of a vehicle body 17.

The dent pulling cone assembly 14 is more clearly understood by reference to FIGS. 2–6. In this regard, the cone assembly 14 includes the aforementioned dent pulling attachment rod 16 which is similar in shape to a blunt tipped nail and effectively comprises a metal rod having an integral flat head 18. The flat head 18 of the rod 16 is designed to receive an adhesive coating 20 for a purpose which will be subsequently described in greater detail.

The cone assembly 14 further includes a rod guiding and supporting cone 22 consisting of two parallelally aligned, spaced apart disks 24, 26 with these disks being interconnected by a plurality of metallic rods 28. The disk 24 has a centrally positioned, through-extending aperture 30 which is of a slightly greater diameter than the diameter of the rod 16. The larger bottommost disk 26 has a much larger diameter through-extending aperture 32, and this aperture 32 is provided with an interior circumferentially extending groove 34. The aperture 32 is designed to receive one of a plurality of interchangeable disks 36, and each of these disks have circumferentially extending flexible rings 38 which are engagable with the groove 34 when the disk is snap-fitted into the aperture 32. Each interchangeable disk is provided with a different diameter through-extending aperture 40 with the intent being to choose a disk having an aperture which is substantially similar in size to a dent to be repaired, and each disk 36 may be constructed either in a flat or concave manner to better fit the type of dent being removed.

With respect to the manner of usage of the present invention 10 in a typical situation, the metal rod 16 should be no larger than ⅛th inch in diameter, and the head 18 of the rod is coated with a heat activated adhesive 20 so as to allow it to be glued to the deepest spot in a dent. The force required to remove the dent is obtained by the aforedescribed commercially available "pulling" tool 12. The cone 22 is positioned over the rod 16 with the narrow end of the rod being inserted through the aperture 30, and the rod may then be heated until the adhesive reaches a required working temperature (usually indicated by the glue turning white to clear). Heat may be provided by any conventional means, such as by a lighter, a soldering iron, a small propane torch, etc. Once the adhesive is activated, the cone 22 is placed over an existing dent so that the center line of the rod 16 is positioned in the deepest part of the dent, and the entire assembly is then held in place until the adhesive has set up. The cone 22 may then be removed from the rods 16, and a proper size interchangeable disk 36 is snap fitted into the aperture 32 formed in the cone end 26. After repositioning the cone 22 over the rod 16 (large end 26 goes over first), the pop rivet tool 12 is placed on the rod and used to draw the cone tightly against the damaged plane of the vehicle's body. Additional pulling force is then applied to remove the dent and once the dent has been removed, the rod 16 is reheated and removed. Minor compounding and polishing may be required to restore the original luster to the surface paint.

As can be appreciated, the advantage of the present invention 10 is that it eliminates surface grinding to bare metal which is necessary in other methods of dent removal, nor does it require a high skill level usually necessary with conventional methods. Further, the need is eliminated for special refinishing and repairing equipment and as such, the present invention 10 is ideal for both non-professional and professional use.

FIGS. 7 and 8 illustrate the fact that the present invention may be sold in a kit form which includes a kit housing 42 designed with special slots for holding the cone 22, each of the interchangeable disks 36, the pulling tool 12 and the dent pulling attachment rod 16. Additionally, a small propane torch 44 may be retained within a slot, as can a container of adhesive 46.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved dent puller comprising:

attachment rod means fixedly securable to an existing dent in the vehicle's body;

cone-shaped support means through which said attachment rod means is slidably positionable;

and pulling tool means for applying a pulling force to said attachment rod means thereby to remove said existing dent, wherein said rod attachment means is adhesively attached by a heat activated adhesive to said existing dent, said cone-shaped support means includes first and second parallel aligned disks, said first disk having a guide aperture for said attachment rod means and said second disk having an aperture for receiving a series of interchangeable disks, each of said interchangeable disks having a central aperture sized to conform to the diameter of said existing dent respectively and adapted to be snap fitted within said aperture in said second disk so that said attachment rod means is slidably positionable through the aperture in said first disk and the central aperture in each said respective insert snap fitted in said second disk.

2. The apparatus of claim 1 wherein said second disk includes a circumferentially extending groove disposed in said aperture thereof, and each of said inserts has a flexible ring disposed on the circumferential periphery thereof, said flexible ring being engageable in said groove of said second disk in a snap-fittable manner.

* * * * *